US005685351A

United States Patent [19]

Kazarian et al.

[11] Patent Number: 5,685,351

[45] Date of Patent: Nov. 11, 1997

[54] FILLER ADAPTER FOR A MULTICHAMBERED CONTAINER

[76] Inventors: Randal Kazarian, 624 Olive St., Santa Barbara, Calif. 93101; David Mills, 5747 Gato Ave., Goleta, Calif. 93117

[21] Appl. No.: 546,782

[22] Filed: Oct. 23, 1995

[51] Int. Cl.[6] ..... B65B 1/04

[52] U.S. Cl. ..... 141/325; 141/340; 141/364; 141/384; 220/525; 220/253; 215/228

[58] Field of Search ..... 141/247, 297, 141/299, 325, 326, 331, 338, 340, 345, 346, 363–368, 383, 384; 222/144.5, 132, 129; 220/212, 555, 525, 253; 215/6, 228, 313

[56] References Cited

U.S. PATENT DOCUMENTS

| | | | |
|---|---|---|---|
| 1,676,986 | 7/1928 | Hilford | 141/340 |
| 3,599,681 | 8/1971 | Hall | 141/383 |
| 4,150,089 | 4/1979 | Linet | 215/6 |
| 4,705,192 | 11/1987 | Knapton | 222/144.5 |

*Primary Examiner*—Henry J. Recla
*Assistant Examiner*—Steven O. Douglas
*Attorney, Agent, or Firm*—Michael G. Petit

[57] ABSTRACT

A filler adapter assembly for a multichambered container. The filler adapter mounts on the open end of a multichambered container. The filler adapter enables individual chambers within the container to be emptied or filled without contaminating adjacent chambers. The assembly includes a filler adapter and a releasable closure. The filler adapter is a hollow tubular member having a closure end which matingly engages the open end of the container. The closure end provides plugs and a gasket for sealing all chambers except a single selected chamber. A small opening in the closure end overlies the selected chamber providing fluid communication between the selected chamber and a conical lumen within the filler adapter. The releasable closure provides a leak proof seal between the filler adapter and container. The stem of the funnel or similar device may be placed in the larger opening of the conical lumen and a fluid introduced into the selected chamber. Likewise, fluid may be drained from the selected chamber by simply inverting the container with the filler adapter assembly in place. Plugs in the closure end of the filler adapter occlude the openings of the other chambers, preventing drainage of fluid therefrom, while the larger opening in the conical lumen provides drainage for emptying the desired chamber. An air vent in the filler adapter enables the escape of gas during filling and provides on overflow channel for preventing overfilling the chamber.

9 Claims, 4 Drawing Sheets

FILLER ADAPTER FOR A MULTICHAMBERED CONTAINER

BACKGROUND OF THE INVENTION

1. Field of the Invention

This invention relates to multichambered fluid containers and, more particularly, a device for filling and emptying one of a plurality of chambers within a multichambered container vessel.

2. Prior Art

Multichambered containment vessels are known in the art. For example, U.S. Pat. No. 5,009,342 to Lawrence et al. discloses a dual liquid dispensing assembly. The assembly includes a container vessel having two compartments therewithin. The compartments are adapted to hold different fluids. U.S. Pat. No. 5,152,431 to Gardner et al. discloses a pump apparatus for dispensing one of a plurality of liquids contained within separate chambers of a container. Gardner et al. generally disclose a container vessel having at least three chambers and a dispensing head affixed thereto. The dispensing head comprises a spray nozzle having an intake orifice which is switchable to any one of the plurality of chambers for selective switchable dispensation of fluid contained therewithin.

In U.S. Pat. No. 5,370,275, the present inventors disclose an adapter valve for removable connection of a prior art dispenser spray nozzle to a multichambered containment vessel. The adapter provides means for switching the intake orifice of the dispenser spray nozzle between one of a plurality of chambers within a containment vessel. The device is a member having one end adapted to receive one of a plurality of different spray nozzles. A releasable closure such as a screw-top closure operable for releasable attachment of the adapter to the container is located on the other end.

The above representative prior art recites and teaches the advantages of a multichambered containment vessel. Further, they disclose switchable means for dispensing fluids from any one of the plurality of chambers within the vessel. What is lacking is a recognitive of the problem encountered while attempting the filling and emptying of an individual chamber within the vessel when such is required. Moreover, the multichambered containment vessels are normally open-topped bottles having internal partitions dividing or segmenting the interior volume of the container bottle into a plurality of discrete fluid-tight chambers. Each of the plurality of chambers has a single opening therein which openings are adjacent to one another at the open end of the container thereby segmenting the container opening. This "packing" of individual chamber openings into the open end of the container requires the partitioning of the open end of the container into a plurality of smaller individual openings, one for each chamber within the container. The reduced size of each chamber opening renders it difficult to introduce fluids thereinto.

It is therefore, desirable to provide an assembly having a conical lumen therewith which is large on one end and the same size as a chamber opening on the other which may be releasably connected to the open top of a multichambered containment vessel thereafter to isolate one chamber from the plurality of chambers and to facilitate the introduction of a fluid into the isolated one of the plurality of chambers and/or permit the emptying of the isolated one of the plurality of chambers in the container while preventing cross-contamination with fluids contained in other chambers by fluid transfer between chambers.

SUMMARY OF THE INVENTION

It is an object of the present invention to provide a filler adapter assembly operable for guiding and introducing a fluid into one of a plurality of chambers within a multichambered containment vessel.

It is yet another object of the invention to provide a filler adapter which provides means for the leak-proof attachment of the device to a multichambered containment vessel.

It is still another object of the invention to provide a filler assembly for a multichambered containment vessel wherein the filler adapter provides a vent to enable gas to escape during the introduction of a fluid into a chamber, and for preventing the overflow of a fluid being introduced into a chamber.

The features of the invention believed to be novel are set forth with particularity in the appended claims. However, the invention itself, both as to organization and method of operation, together with further objects and advantages thereof may best be understood by reference to the following description taken in conjunction with the accompanying drawings in which:

DESCRIPTION OF THE PREFERRED EMBODIMENTS

Figure 1:
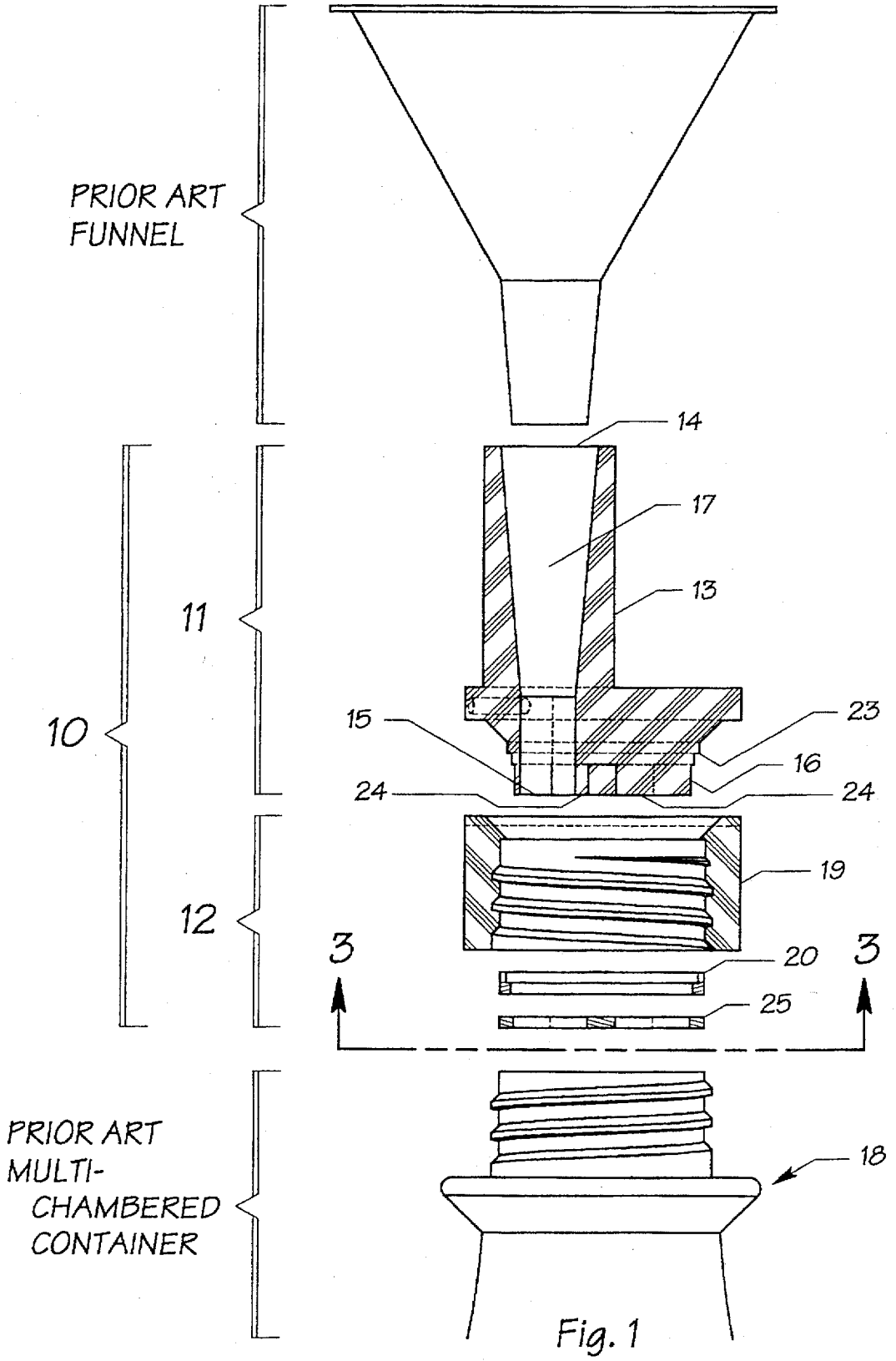
FIG. 1 is a telescopic vertical cross sectional view of the filler assembly in accordance with present invention showing a prior art funnel and the finish area of a prior art multichambered containment vessel.

An exploded view of the filler assembly of the present invention is shown at 10 in FIG. 1 in relationship to a prior art funnel and multichambered container. The filler assembly 10 comprises a filler adapter portion 11 and a releasable closure portion 12. The filler adapter 11 comprises tubular portion 13 having a relatively large diameter opening 14 in the top thereof, and a smaller opening 15 in the base 16. The opening 15 and the larger opening 14 are in fluid communication with one another by means of a conical lumen 17 extending between the large opening 14 and the smaller opening 15 in the base 16 thereafter having the same shape as a chamber orifice (not shown) of the multichambered container 18. The filler assembly 10 is releasably affixed to multichambered container 18 by means of a releasable closure 12. One embodiment of the releasable closure 12 comprises a threaded ring 19 which is rotatably affixed to the base portion 16 of the filler adapter 11 by means of an annular stop ring 20. The inner perimeter of the stop ring 20 is bonded to a step in the base 16 of the filler adapter 11.

Figure 2:
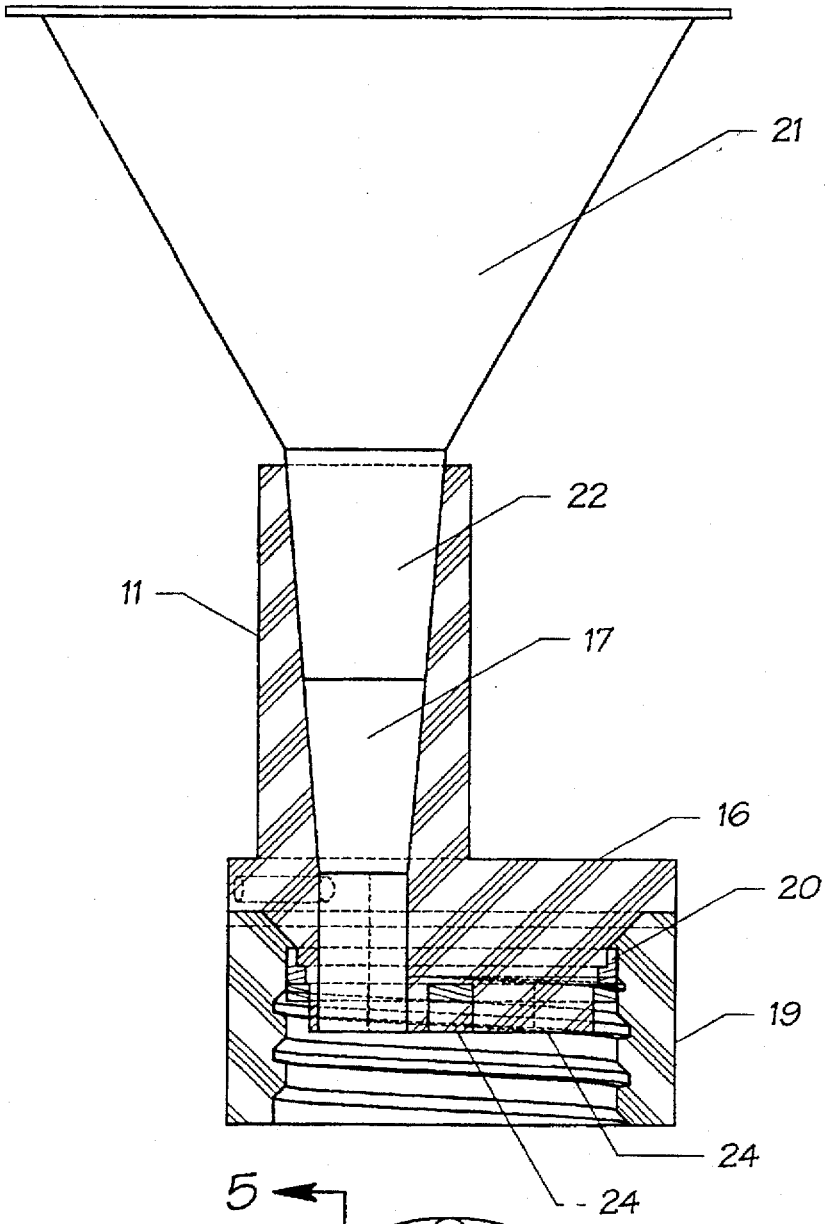
FIG. 2 is a vertical sectional view of the filler assembly of FIG. 1 showing the stem of a prior art funnel inserted into the large opening into the conical lumen of the filler adapter.

The elements of the assembly are shown more clearly in FIG. 2. A prior art funnel 21 has a stem 22 inserted within the conical lumen 17 of the filler adapter 11. The threaded ring 19 is affixed to the base portion 16 of the filler adapter 11 by means of the stop ring 20 which is bonded to one of the steps 23 within the base 16 of the filler adapter 11 as described earlier. The threaded ring is free to rotate around the central axis of the substantially cylindrical filler adapter 11. The stop ring 20 which is bonded only to the step 23 on the base 16 of the filler adapter 11, holds the threaded ring 19 against the base 16 of the filler adapter 11 while permitting it to rotate therearound. A plurality of plugs 24 project from the base portion 16. Each of the plugs 24 have a cross section, shown more clearly in FIG. 5, which matingly fits within the corresponding chamber opening (not shown) within the containment vessel 18. The plugs 24 are solid protrubances which occlude the respective mating chamber openings when the filler assembly is affixed to the finish area of the multichambered containment vessel 18. Only the single projection 15 has an opening therewithin to permit fluid communication between the open end 14 of the filler adapter 11 and a chamber within the multichambered containment vessel 18.

Figure 5:
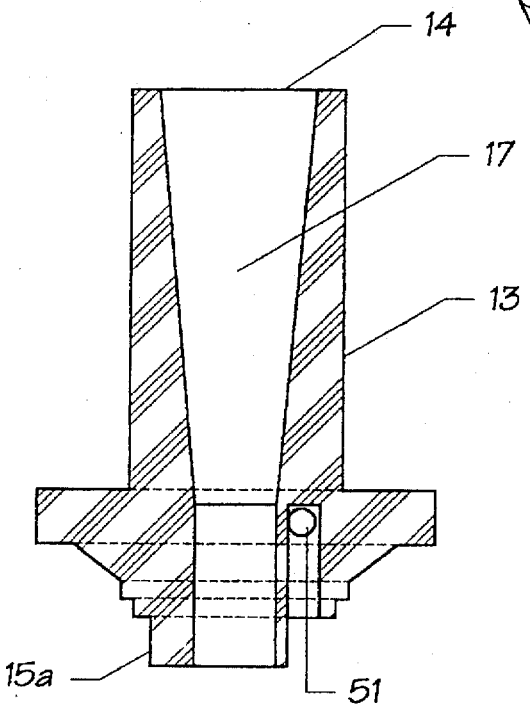
FIG. 5 is a vertical cross sectional view of the filler adapter without the threaded closure in accordance with FIG. 4, viewed along section line 5—5 of FIG. 3.

The filler adapter 11 is preferably of unitary construction, made in a single piece from a suitable plastic material. A vent hole 51, shown more clearly in FIG. 5, provides an opening for gas to escape from the isolated chamber being filled as fluid is being added thereinto. The vent hole 51 also serves as an overflow to prevent fluid from spilling over the open end 14 of the filler adapter 11.

Figure 3:
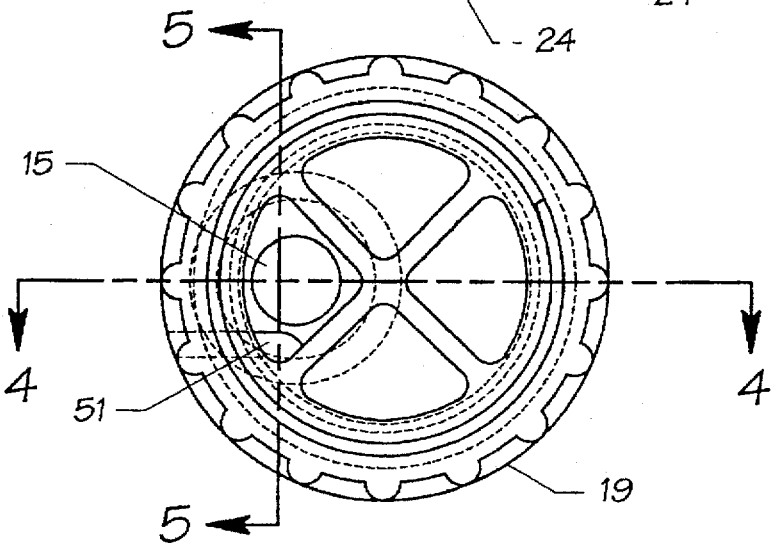
FIG. 3 is a bottom view of the filler assembly of FIG. 2.
Figure 4:
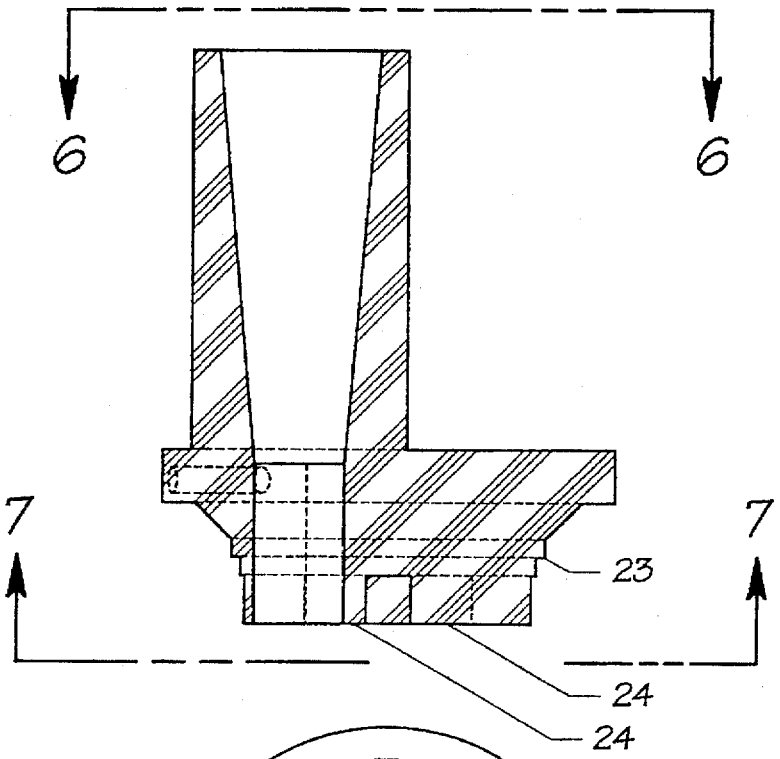
FIG. 4 is a cross sectional front view of the filler adapter portion of the filler assembly viewed along section line 4—4 of FIG. 3.

Construction of the assembly is shown in FIGS. 3–10. FIG. 3 is a bottom view of the assembly of FIG. 2 without the funnel. FIG. 4 shows a cross sectional view of the filler adapter 11 portion of the filler assembly 10 and viewed along section line 4—4 of FIG. 3.

Figure 6:
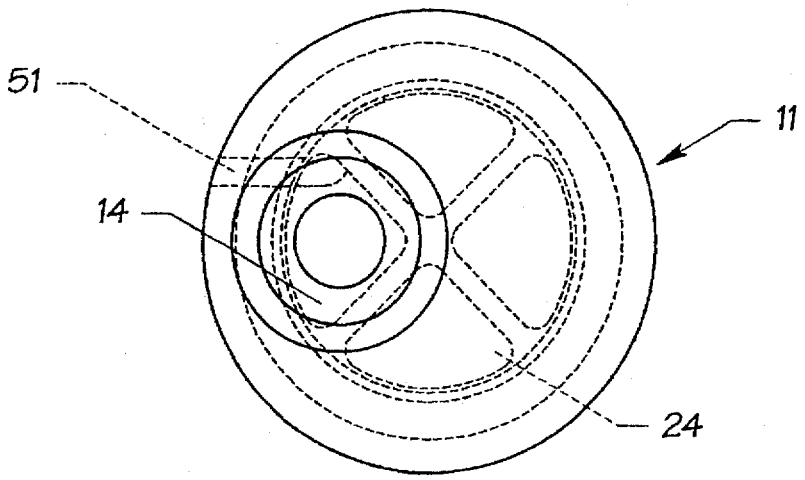
FIG. 6 is a view of the filler adapter in accordance with FIG. 4 viewed from the top in the direction of line 6—6.
Figure 7:
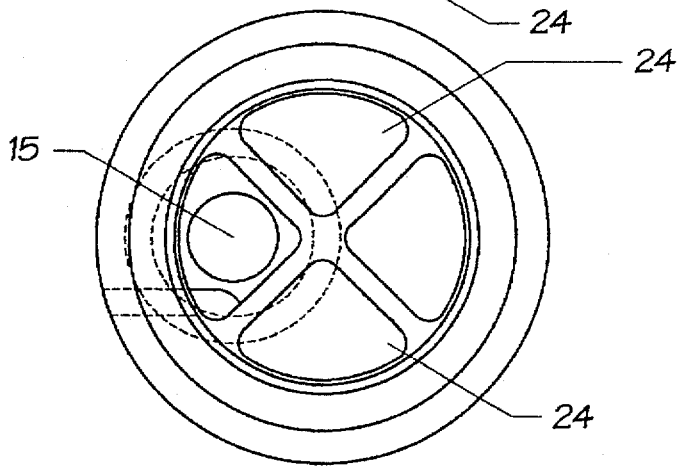
FIG. 7 is a bottom view of the filler adapter of FIG. 4.

FIG. 5 is a vertical cross sectional view of the filler adapter 11 without the releasable closure in accordance with FIG. 4, viewed along section line 5—5 of FIG. 3. A top view of the filler adapter 11 of the filler assembly 10 is shown in FIG. 6. FIG. 7 shows a bottom view of the filler adapter portion of the filler assembly in accordance with FIG. 4.

Figure 8:
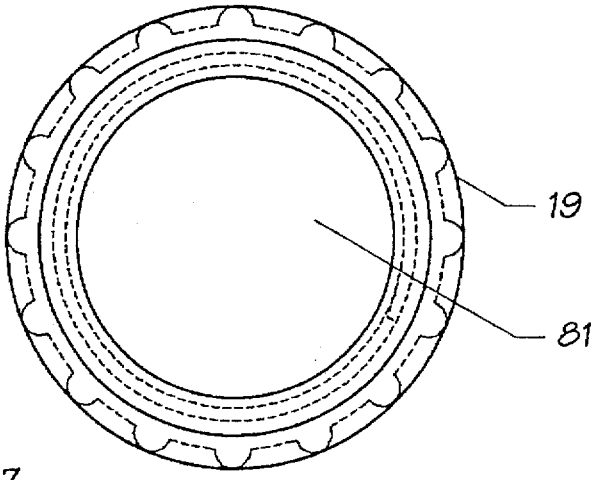
FIG. 8 shows a top view of the threaded portion of one embodiment of the releasable closure.
Figure 9:
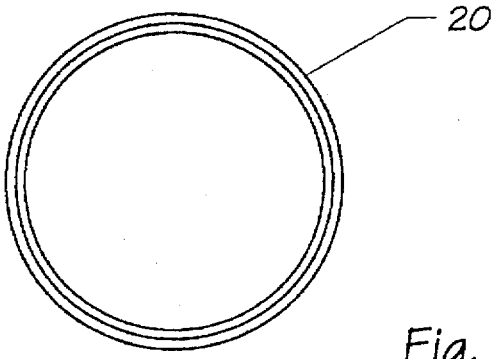
FIG. 9 is a top view of a stop ring which is employed to hold the releasable closure against the filler adapter.
Figure 10:
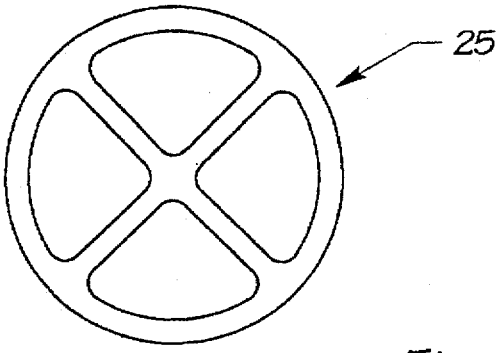
FIG. 10 is a top view of a rubber gasket having a plurality of lumens therewithin which forms the seal between the threaded closure and the container vessel.

The construction of a particular embodiment of a releasable closure 12 is shown in FIG. 8, 9 and 10. The releasable closure 12 comprises a threaded ring 19, a top view of which is shown in FIG. 8, and a cross sectional view show in FIG. 1. The threaded ring 19 is an annular member having a hollow interior 81. A stop ring 20 shown in FIG. 9 fits inside the threaded ring 19 and is bonded around its inner circumference to a step 23 on the filler adapter. A gasket 25 (FIGS. 1 and 10) provides a fluid tight seal between the top of a prior art multichambered containment vessel and the filler assembly of the present invention.

While particular embodiments of the present invention have been illustrated and described, it would be obvious to those skilled in the art that various other changes and modifications can be made without departing from the spirit and scope of the invention. For example, the male plugs on the base of the filler adapter portion of the assembly may be dimensioned to snugly engage the respective mating female chamber openings in the multichambered container providing a friction closure. Such a construction would obviate the need for a releasable closure. In addition, the large opening in the conical lumen of the filler adapter may be dimensioned to receive and direct a fluid into a particular chamber without the interposition of a funnel. It is therefore intended to cover in the appended claims all such changes and modifications that are within the scope of this invention.

What we claim is:

1. A filler adapter assembly for isolating and providing fluid communication with the interior volume of a particular chamber within a multichambered container, the multichambered container having a plurality of discrete fluid-tight chambers therewithin wherein each of the discrete chambers has an opening thereinto and wherein each opening is adjacent to a corresponding opening within each other chamber, the filler adapter assembly comprising a hollow, substantially cylindrical filler adapter having a top end with a large opening therein, and a substantially flat base end opposite thereto, said base end having a plurality of plugs protruding outwardly therefrom sized to fit into the openings in the multichambered container, and wherein one of said plurality of plugs has a small opening therewithin, said filler adapter having a fluid conducting lumen coextensive therewith providing fluid communication between said large opening in said top end and said small opening in said one plug, said filler adapter further having a releasable closure means operable for releasably affixing said filler adapter assembly in leak-proof attachment to the multichambered container, said releasable closure means including a gasket means which provides a fluid tight seal between the top of the multichambered container vessel and the filler adapter assembly.

2. The filler adapter assembly of claim 1 wherein said releasable closure means operable for releasably affixing said filler adapter assembly in leak-proof attachment to the multichambered container further comprises a threaded ring free to rotate around the filler assembly and adapted to thread onto a corresponding threaded end of the multichambered container vessel.

3. The filler adapter assembly of claim 1 wherein said filler adapter has a central axis and wherein said small hole in said base end is lateral to said central axis.

4. The filler adapter assembly of claim 1 wherein at least a portion of said fluid conducting lumen is conical.

5. The filler adapter assembly of claim 1 further comprising a venting lumen in said filler adapter assembly, said venting lumen extending radially outward and providing fluid communication between said one plug with said small opening and an outer perimeter of said filler adapter assembly.

6. A filler adapter assembly for filling and emptying a chamber within a multichambered container, the multichambered container having a plurality of discrete fluid-tight chambers therewithin wherein each of the discrete chambers has an opening thereinto adjacent to the corresponding opening on each other of the plurality of chambers, the filler adapter assembly comprising a filler adapter having unitary construction and having a top end with a large conical opening therein, a substantially flat base having a plurality of plugs projecting therefrom sized to fit into the openings in the multichambered container, wherein only one of said plurality of plugs has a small opening therein, and a body portion therebetween, the body portion further comprising a tapered lumen providing fluid communication between said large opening and said small opening, and wherein at least a portion of said lumen is conical, said filler adapter further having a releasable closure means operable for releasably affixing the filler adapter assembly in leak-proof attachment to the multichambered container, the releasable closure means including a gasket means and which provides a fluid tight seal between the top of the multichambered container vessel and the filler adapter assembly.

7. The filler adapter assembly of claim 6 wherein said releasable closure means operable for releasably affixing said filler adapter assembly in leak-proof attachment to the multichambered container further comprises a threaded ring disposed to freely rotate around the filler assembly and adapted to thread onto a matingly threaded end of the multichambered container vessel thereby forming a fluid-tight seal between said filler assembly and said multichambered container.

8. The filler adapter assembly of claim 6 wherein said body portion has a central axis and wherein said small hole in said one plug projecting from said base end is lateral to said central axis.

9. The filler adapter assembly of claim 8 wherein said large conical opening in said top end of said filler adapter is coaxial with respect to said central axis.

* * * * *